United States Patent [19]

Goerig et al.

[11] 4,078,482

[45] Mar. 14, 1978

[54] METHOD OF EMBOSSING INDICIA ON SOAP WITH AN ELASTOMERIC COATED PRINTING HEAD

[75] Inventors: Wayne William Goerig; Toshio Kanehara, both of Honolulu, Hi.

[73] Assignee: Tokyo International Products, Inc., Tokyo, Japan

[21] Appl. No.: 696,592

[22] Filed: Jun. 16, 1976

[51] Int. Cl.[2] ..... B44C 1/24

[52] U.S. Cl. ..... 101/32; 101/426; 252/93; 427/258; 428/203

[58] Field of Search ..... 101/32, 33, 426, 35; 428/161, 203, 484, 343; 252/90, 93, 134, 174; 427/258, 264; 264/293

[56] References Cited

U.S. PATENT DOCUMENTS

| | | | |
|---|---|---|---|
| 2,423,435 | 7/1947 | Block | 252/134 X |
| 3,413,230 | 11/1968 | Dupuis | 252/134 X |
| 3,432,325 | 3/1969 | Baba | 427/258 X |
| 3,446,900 | 5/1969 | Kamen | 101/32 X |
| 3,616,178 | 10/1971 | Gurin et al. | 428/343 |
| 3,688,695 | 9/1972 | James | 101/426 X |
| 3,760,724 | 9/1973 | Budzinski et al. | 101/426 |
| 3,808,024 | 4/1974 | Witman | 428/203 X |
| 3,926,828 | 12/1975 | O'Neill et al. | 252/134 X |
| 3,936,384 | 2/1976 | Williams | 252/174 X |
| 3,950,290 | 4/1976 | Drury, Jr. et al. | 427/258 X |

OTHER PUBLICATIONS

"The Technology of Lithoblankets" The British Ink Maker, Feb. 1971, pp. 74, 76, 78, 80.

*Primary Examiner*—E. H. Eickholt
*Attorney, Agent, or Firm*—John J. Byrne; Edward E. Dyson

[57] ABSTRACT

A method of embossing an indicia on a bar of soap to obtain a water-impervious painted design is disclosed which comprises printing the indicia on the surface of the soap with a silicone printing head and utilizing a paint selected from the group consisting of fast drying lacquer paint and a fast drying enamel paint and coating said printing with a substantially transparent or translucent lacquer coat.

14 Claims, 2 Drawing Figures

METHOD OF EMBOSSING INDICIA ON SOAP WITH AN ELASTOMERIC COATED PRINTING HEAD

BACKGROUND OF THE INVENTION

Figure 1:
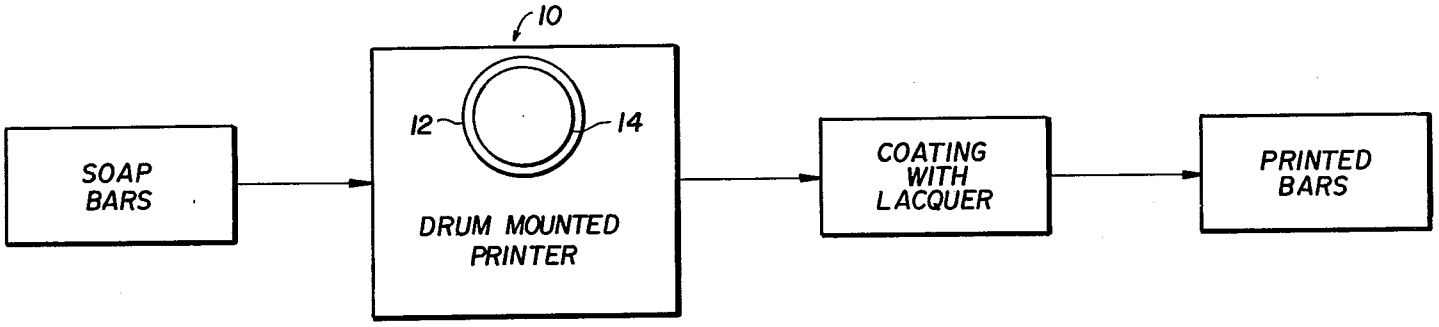

This invention relates to a method of embossing an indicia on a bar of soap. More specifically, this invention relates to a method of embossing an indicia on the surface of a bar of soap utilizing a printing head comprising an elastomeric silicone and a paint selected from the group consisting of a fast drying lacquer and fast drying enamel paint.

It is common knowledge that the surface of a bar of soap degrades during contact with water. As a result thereof any writing or indicia placed on the soap will be of little, if any, value after the initial use. A method providing a permanent indicia or an indicia on various subsurfaces of a bar of soap have heretofore been too costly to warrant the application of the same to commercial usage. The advertising and product identification value of an indicia on a bar of soap is of great value as long as the cost of placing thereon, and likewise maintaining the indicia, is not too great to defeat the reward derived from the advertising and identification of the product.

It is therefore an object of this invention to provide a simplified method for embossing of an indicia on a bar of soap utilizing a printing head comprising an elastomeric layer thereon.

It is a further object of this invention to provide a method of embossing an indicia on the surface of a bar of soap utilizing a fast drying lacquer or fast drying enamel paint in combination with a printing head having an elastomeric silicone layer on the exterior of the printing head to produce a lasting graphic design or message.

DESCRIPTION OF THE PRIOR ART

In recent years, the desirability of utilizing elastomers in offset printing processes for printing objects such as containers of glass or plastic having curved walls has been recognized. The patent to Clyde O. Childress, U.S. Pat. No. 3,587,577 issued on June 28, 1971 (cl. 101-35), is representative of a device capable of printing on complex contoured surfaces with an elastomeric printing head. In more recent years, it has been recognized that the use of silicone rubbers is most advantageous for these purposes. The patent to Gurin, U.S. Pat. No. 3,616,178 issued on Oct. 26, 1971, for instance, suggests the use of a silicone rubber or a fluorocarbon silicone rubber as a material desirable for these purposes. In contradistinction, the invention herein is directed to a method of printing soap by placing intricate designs on a bar of soap utilizing the truly remarkable details which can be printed on contoured complex soap surfaces with the use of silicone rubber compounds. Soap, because of its porosity and other physical characteristics, presents a particularly difficult surface on which to print. One of the principal objectives of this invention is to set forth a method of overcoming these difficulties.

A particular soap printing process is exemplified by U.S. Pat. No. 3,432,325, Baba et al (cl. 117–12) which describes a distinct method of embossing an indicia to a bar of soap. As a result of the difficulties encountered by soap surfaces, the patentee specifically discloses that an indicia is placed on the soap by first forming a thin layer of alkyd resin or oil modified alkyd resin to the surface of the soap by such means as brushing, dipping, or spraying while the coated lacquer surface is at least partially wet; the indicia or graphic design is printed on the lacquer by a suitable printing apparatus. It is noted that no particular printing apparatus is disclosed for advantageous printing upon the surface of the soap and that the ink or paint used to print the graphic design or indicia by the patentee is disclosed as a vegetable oil, such as a soya and linseed oil and is modified with an oil modified alkyd resin such as castor, coconut or soya oil modified phthalic alkyd resin. Subsequent to the printing of the lacquer-wetted soap the patentee hermetically seals the graphic design or indicia to the base coat by applying a thin layer of transparent or translucent lacquer of substantially the same composition as that utilized to form the base coat. In this manner the patentee has disclosed a method of encapsulation of a graphic design of indicia in a water-impervious layer. In contradistinction to the prior art, the applicant herein discovered a simplified method of placing a hermetically sealed indicia to a bar of soap which comprises utilization of a printing head comprising an elastomeric layer on the exterior thereof and a paint selected from the group consisting of a fast drying lacquer and a fast drying enamel paint. Also the applicant's method does not require the application of a thin alkyd resin layer to the surface of the soap before printing thereon. The instant method contemplates a distinct print or paint from that set forth in Baba et al. It is believed the instant method will result in a simplified method of embossing an indicia to a bar of soap and maintaining the same in a legible condition during the entire use of the soap.

THE DRAWINGS

Referring now to the drawings there will be seen schematic representations of preferred embodiments of the invention.

FIG. 1 is a diagramatic representation of one preferred embodiment of the invention wherein soap bars to be imprinted are passed beneath a printing head 10 including an elastomeric layer 12 mounted upon a drum type printer 14.

Figure 2:
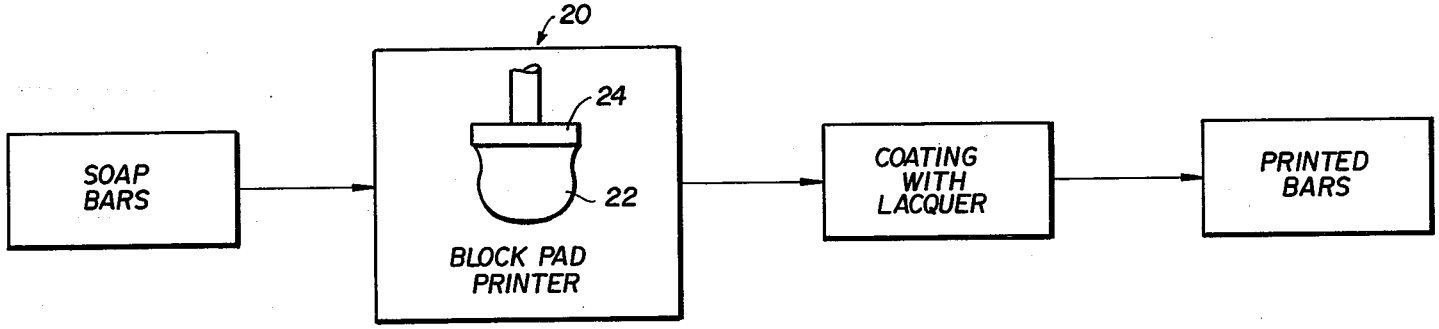

FIG. 2 is a diagramatic representation of another preferred embodiment of the invention wherein soap bars to be imprinted are passed beneath a printing head 20 including an elastomeric layer 22 mounted upon a block pad type printer 24.

ILLUSTRATIVE EMBODIMENTS

In one aspect the embodiment of this invention results in forming an indicia on the surface of a bar of soap which comprises a method of forming an indicia on the surface of a bar of soap which comprises:

(a) printing said indicia with a printing head comprising an elastomeric silicone and a paint selected from the group consisting of a fast drying lacquer paint and a fast drying enamel paint; and (b) coating said indicia and soap surface with substantially transparent lacquer coat.

A specific embodiment of this invention resides in a method for embossing a graphic design resembling a palm tree to a bar of soap which comprises printing the palm tree design with a fast drying lacquer paint and a printing head comprising an elastomeric layer, said fast drying lacquer paint comprising nitrocellulose, a resin, a plasticizer and a solvent and subsequently treating the printed palm tree design with a transparent lacquer coat to prohibit water contact with said design.

Another specific embodiment of this invention resides in a method for embossing a silhouette to the surface of a bar of soap by printing the silhouette with a fluorocarbonic elastomeric printing head and a fast drying nitrocellulose derivative enamel and subsequently treating the painted silhouette with a translucent lacquer coating to prohibit water attrition of the silhouette.

Yet another specific embodiment of this invention resides in the embossing of a name such as "sunshine" to a bar of soap by printing the word with a silicone rubber coated elastomeric printing head and a paint comprising from about 15 to 40% nitrocellulose, from about 15 to 30% resin, from about 1 to 10% plasticizer and from about 10 - 25% solvent and coating the printed word with a transparent lacquer coat to inhibit water impregnation, wherein said resin is ester soluble, the plasticizer is camphor (also known as 2-ketocomphane or 2-camphanone) and the solvent is anhydrous ethyl alcohol.

SUMMARY OF INVENTION

As hereinbefore set forth this invention resides in a method of embossing an indicia to a bar of soap with a printing head comprising an elastomeric layer thereon, a paint selected from a group consisting of a fast drying lacquer paint and a fast drying enamel paint. The actual method of printing on the surface of the soap may be performed utilizing a print head with an elastomeric layer thereon. The elastomeric layer is disposed on the exterior surface of the printing head so as to contact the soap surface. The type of printer may be either block like pad type or the blanket type of printing system, the only necessity being the use of the elastomeric layer on the printing head. The elastomeric layer may be defined as a vulcanized elastomer compound in a hardness range of from about 30 to 96 Shore A, Durometer value, typically vulcanized elastomers being based on natural rubber, polyisoprene NBR rubber, butyl rubber, chlorinated polyisoprene rubber, polyethylene rubber, EPDM rubber, polysulfide rubber, silicon rubber, polyvinyl chloride rubber, ethyl acrylate rubber, silicon rubber, polyvinyl chloride rubber, ethyl acrylate rubber, neoprene rubber, EPR copolymer rubber, Elastothane polyurethane rubber or the elastomeric rubber may be a fluorocarbon elastomeric rubber substrate such as a combination of vinylidene fluoride and hexafluoropropylene. The specific teachings of the type of printing head may be found in U.S. Pat. No. 3,616,178 the teachings of which are incorporated by reference herein. The fast drying lacquer paint will comprise, nitrocellulose, a resin compound, a plasticizer and a solvent. In a preferred embodiment of this invention the fast drying lacquer will possess components in an amount equal of from about 15 to 40% nitrocellulose, from about 15 to 30% resin compound, from about 1 to 10% plasticizer and from about 10 to 24% solvent. Nitrocellulose $[C_6O_5(NO_2)_3]$ is defined in Hackh's Chemical Dictionary 1969 ed. at page 458 as an ester of nitric acid and cellulose such as pyroxylin or guncotton. The complete definition is hereby incorporated by reference to the specification. The second component of the fast drying lacquer paint will comprise a resin compound. Resin compounds are generally classified by their solubility, the resins herein contemplated may be wholly or partially soluble in esters, alcohols, hydrocarbons or ketones. Specific examples of the resin compounds will include Rosin, Thus, Elemi, Mastic, Dammar, Ester gum, Cumar, Shellac, Sandarac, Kauri, Pontianac, Soft manilas, Hard manilas, Congo, Benguela, etc. The exact definition of the solubility of the resins in the various compounds is provided at page 1167 of the Manual of Industrial Chemistry, Rogers 5th ed. vol. 2 which is likewise specifically incorporated by reference to the specification. The third component of the fast drying lacquer is a plasticizer which will comprise nonvolatile organic liquids or low-melting solids such as camphor, phthalate compounds, adipate and sebacate ester and aryl phosphate esters, polyols, etc. The solvents which are the fourth component of the fast drying lacquer paint will generally be anhydrous in nature. The solvent will be selected from the group consisting of an alkanol, a methyl-substituted aromatic hydrocabon and a lower alkyl carboxylic acid ester. Specific examples of alkanols will comprise anhydrous ethyl alcohol, anhydrous propyl alcohol, anhydrous butyl alcohol, anhydrous amyl alcohol, anhydrous hexyl alcohol, anhydrous heptyl alcohol, anhydrous octyl alcohol, anhydrous nonyl alcohol, anhydrous decyl alcohol, etc. Specific methyl substituted aromatic hydrocarbons will comprise toluene, xylene, pseudocumene, mestylene, etc. While specific lower alkyl carboxylic esters will comprise anhydrous ethyl acetate, anhydrous propyl acetate, anhydrous ethyl propionate, anhydrous propyl valerate, anhydrous propyl pelargonate, etc. The fast drying enamel paint is defined as an enamel paint which is characterized by an ability to form an especially smooth thin film in compliance A.S.T.M. test number D-16-57. The fast drying enamel paint will have similar drying properties to that as examplified in the fast drying lacquer paint to provide for quick drying of the indicia on the surface of the soap. Subsequent to the placement of the indicia on the surface of the soap, the surface and indicia are treated with a translucent or transparent lacquer cellulose to encapsulate the painted design from water contact. The coating lacquer may be any conventional lacquer which is conventional in nature. It is also contemplated within the scope of this invention that the transparent lacquer surface may be coated with a paraffinic material to prevent water entry during natural degradation of the soap. Also the transparent lacquer may be coated by means of an artist spray commonly referred to as "Matte" which may be purchased from the Borden Co. of Columbus, Ohio.

In a general manner, while there have been disclosed effective and efficient embodiments of the invention, it should be well understood that the invention is not limited to such embodiments as there might be changes made in the arrangement, disposition, and form of the parts without departing from the principle of the present invention as comprehended within the scope of the accompanying claims.

I claim:

1. A method of forming an indicia on the surface of a bar of soap which comprises:

(a) printing said indicia with at least one printing head of an elastomeric silicone and a paint selected from the group consisting of a fast drying lacquer paint and a fast drying enamel paint directly upon the surface of the bar of soap; an (b) directly coating said indicia and soap surface with a substantially transparent lacquer coat.

2. The method of claim 1 further characterized in that a substantially transparent paraffin layer is applied to the exterior surface of the substantially transparent lacquer coat.

3. The method of claim 2 further characterized in that said lacquer paint comprises nitrocellulose, a resin, a plasticizer, and a solvent.

4. The method of claim 3 further characterized in that the components of said lacquer paint are present in an amount equal to from about 15 – 40 percent nitrocellulose, from about 15 – 30 percent resin, from about 1 – 10 percent plasticizer and from about 10 – 25 percent solvent.

5. The method of claim 3 further characterized in that the resin is ester soluble, the plasticizer in camphor and the solvent is selected from the group consisting of an alkanol, a methyl-substituted aromatic hydrocarbon and a lower alkyl carboxylic acid ester.

6. The method of claim 4 further characterized in that the alkanol is anhydrous ethyl alcohol.

7. The method of claim 5 further characterized in that the aromatic hydrocarbon is toluene.

8. The method of claim 5 further characterized in that the aromatic hydrocarbon is xylene.

9. The method of claim 5 further characterized in that the alkyl caboxylic ester is anhydrous ethyl acetate.

10. The method of claim 1 further characterized in that the fast drying enamel paint is a cellulose enamel.

11. The method of claim 10 further characterized in that the cellulose enamel is nitrocellulose enamel.

12. The method of claim 1 further characterized in that a layer of silicon rubber is disposed on the exterior surface of said printing head.

13. The method of claim 1 further characterized in that said elastomeric layer comprises a silicon rubber layer which contacts said soap whereby said indicia is painted on said soap surface by said fast drying lacquer paint or fast drying enamel paint.

14. The method of claim 1 further characterized in that said elastomeric layer comprises a polyvinyl chloride rubber which contacts said soap whereby said indicia is painted on said soap surface by fast drying lacguer paint or fast drying enamel paint.

* * * * *